United States Patent [19]

Barma et al.

[11] Patent Number: 4,866,452

[45] Date of Patent: Sep. 12, 1989

[54] HEATED DISH ANTENNAS

[75] Inventors: Pradeep Barma, Fremont; Chi-Ming Chan, Palo Alto, both of Calif.

[73] Assignee: Raychem Corporation, Menlo Park, Calif.

[21] Appl. No.: 302,103

[22] Filed: Jan. 24, 1989

Related U.S. Application Data

[63] Continuation of Ser. No. 913,290, Sep. 30, 1986, abandoned.

[51] Int. Cl.[4] ..... H01Q 1/02

[52] U.S. Cl. ..... 343/704

[58] Field of Search ..... 343/704

[56] References Cited

U.S. PATENT DOCUMENTS

| | | | |
|---|---|---|---|
| 2,679,003 | 5/1954 | Dyke et al. | 343/704 |
| 2,679,004 | 5/1954 | Dyke et al. | 343/704 |
| 3,805,017 | 4/1974 | Roberts et al. | 343/704 |
| 4,304,987 | 12/1981 | van Konynenburg | 219/553 |

FOREIGN PATENT DOCUMENTS

| | | | |
|---|---|---|---|
| 1109913 | 9/1981 | Canada | 343/704 |
| 2163168 | 5/1972 | Fed. Rep. of Germany . | |
| 2551366 | 5/1977 | Fed. Rep. of Germany | 343/704 |
| 3525488 | 1/1987 | Fed. Rep. of Germany . | |
| 2426343 | 12/1979 | France | 343/704 |
| 57-208702 | 12/1982 | Japan . | |
| 0208703 | 12/1982 | Japan | 343/704 |
| 211389 | 11/1940 | Switzerland | 343/704 |
| 2059155 | 4/1981 | United Kingdom . | |

*Primary Examiner*—William L. Sikes
*Assistant Examiner*—Robert E. Wise
*Attorney, Agent, or Firm*—Timothy H. P. Richardson; Herbert G. Burkard

[57] ABSTRACT

A dish antenna for receiving or transmitting signals, e.g. via a satellite, is heated by means of radiant heat from an electrical heater located behind the antenna and spaced apart therefrom. This keeps the antenna free from ice and snow and minimizes distortion. The heater is preferably a self-regulating sheet heater comprising a PTC conductive polymer.

22 Claims, 2 Drawing Sheets

HEATED DISH ANTENNAS

Cross Reference to Related Applications

This application is a file wrapper continuation of copending application Ser. No. 06/913,290 (MP1149-US1), filed Sept. 30, 1986, and now abandoned, the entire disclosure of which is incorporated herein by reference. It is also related to a continuation application under 37 CFR 1.60 of copending application Ser. No. 06/913,920 which is being filed contemporaneously with this application and is now abandoned.

BACKGROUND OF THE INVENTION

1. Field of the Invention

This invention relates to dish antennas, eg. for receiving and/or transmitting signals from satellites or terrestrial microwave antennas, and in particular means for heating such antennas.

2. Introduction to the Invention

The use of dish antennas, particularly for receiving signals from satellites, is increasing rapidly. Dish antennas vary widely in size, but many have diameters of 1 to 7 meters; for example, 1.2 meter and 1.8 meter aperture antennas are most frequently used for signals in the 12–14 GHz band which is widely used for private networks transmitting data, voice and video communications. FCC Regulation 25.209 sets radiation pattern sidelobe envelope requirements for both transmit and receive antennas, and a major concern of antenna manufacturers and users is to ensure not only that antennas meet those requirements when first manufactured, but also that they do not become distorted subsequently, so that the requirements are no longer met. If ice or snow is present on a dish antenna, it frequently causes distortion of the shape of the antenna and/or attenuation of the signal; the larger the dish, the more serious the problems are likely to be. Much effort, therefore, has been devoted to methods of heating dish antennas to keep them free from ice and snow. Unfortunately, however, no method has been found which is technically satisfactory and economically acceptable; and if care is not taken, the heating can itself cause distortion of the antenna.

SUMMARY OF THE INVENTION

We have now discovered that dish antennas can be very satisfactorily heated, and thus kept free of ice and snow, by means of an electrical heater which is placed behind the antenna and spaced apart therefrom, so that the antenna is heated by radiation from the heater.

In one aspect, the present invention provides a dish antenna assembly which comprises (1) a dish antenna having a concave front surface and a convex back surface; and (2) an electrical heater in the form of a sheet having a first surface and an opposite second surface, the first surface being adjacent to the back surface of the antenna but substantially separated therefrom by a medium which is substantially transparent to thermal radiation, typically air, so that heat generated by the heater radiates from the first surface and strikes the back surface of the antenna.

As further described below, the heaters used in this invention preferably comprise a resistive element in the form of a sheet; however they can alternatively comprise one or more strip heaters secured to a thermally conductive sheet, preferably of metal. All such heaters are included in the term "sheet heater" or "heater in the form of a sheet" as used herein.

BRIEF DESCRIPTION OF THE DRAWING

The invention is illustrated in the accompanying drawing, in which.

DETAILED DESCRIPTION OF THE INVENTION

Figure 1:
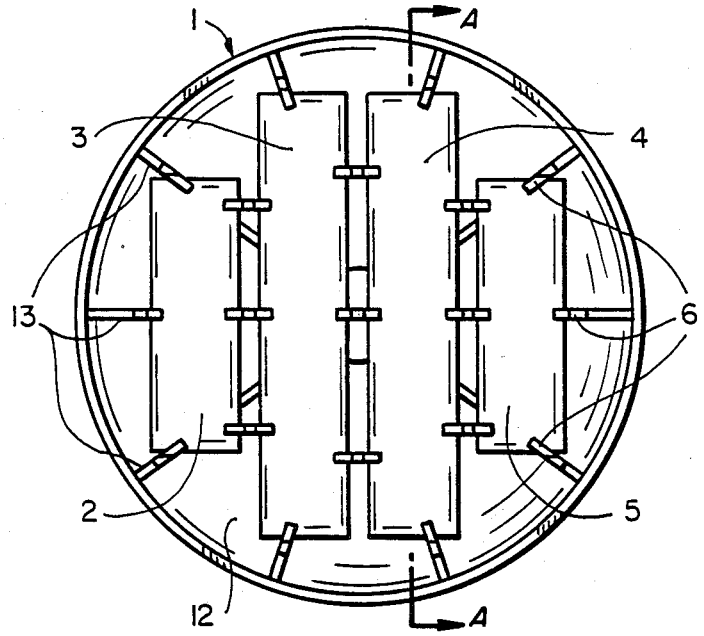
FIG. 1 is a diagrammatic back view of an assembly of the invention.

The sheet heater must be positioned so that it is substantially separated from the antenna by a medium which is substantially transparent to thermal radiation, usually air, so that heat generated by the heater radiates from the heater through the medium and strikes the back surface of the antenna. Typically, the distance between the first surface of the heater and the back surface of the antenna is 3 to 6 inches. In known methods in which an electrical resistance heater is placed in direct contact with an antenna, heating of the antenna takes place mainly or exclusively by conduction. In the present invention, by contrast, little or none of the heating of the antenna is the result of conduction and a substantial proportion, preferably at least 40%, particularly at least 60%, of the heating of the antenna is the result of radiation. The antenna is generally also heated by free convection from air (or other gas) which lies between the antenna and the heater. The air is preferably still air, i.e. any movement thereof is solely the result of convection currents.

We have found that by heating the antenna in this way, the antenna is heated surprisingly uniformly even when the cooling effect of ice or snow is localized, and that as a result, improved signal reception and transmission, and compliance with the FCC regulations, are achieved. This is apparently due to a combination of two factors. First, heat can be transferred to a localized cold spot not only from the portion of the heater directly opposite the cold spot, but also (though to a gradually decreasing extent) by the adjacent parts of the heater which can "view" the cold spot. Secondly, the heat transferred by radiation from the heater to the antenna is not directly proportional to the temperature difference between them (as it is if the heat is transferred by conduction) but is proportional to $T_H^4-T_A^4$, where $T_H$ is the temperature of the first surface of the heater and $T_A$ is the temperature of the back surface of the antenna (in °K.).

Another important advantage of the present invention stems from the fact that dish antennas generally comprise a plurality of ribs which extend from the back surface of the antenna. As a result, if an electrical resistance heater is to be placed in direct contact with the antenna, a large number of specially shaped and interconnected component heaters must be used, and they must contact substantially the whole of the antenna.

When radiant heating is employed, as in the present invention, the heater can be positioned clear of the ribs, thus making it possible to use one or a relatively small number of sheet heaters, e.g. less than 8, for example 4 to 6, each of which has an easily manufactured shape, e.g. a rectangular shape. Furthermore, it is not necessary for the heater to cover the whole of the back surface of the antenna. The ratio of the area of the heater to the area of the back surface of the antenna (ignoring the ribs) should generally be at least 0.3, but it need not be (though of course it can be) as high as 1.0; thus the ratio is preferably 0.4 to 0.9, particularly 0.5 to 0.8.

Direct physical contact between the antenna and the heater is preferably minimized, especially when the antenna comprises ribs of metal or other thermally conductive material, since heating of the antenna by conduction through the ribs tends to cause irregular heating, and consequent distortion, of the front surface. Thus it is preferred that at least 90%, particularly at least 95%, especially substantially 100%, of the first surface of the heater is exposed to the air (or other medium which separates the dish antenna and the heater). If the heater is secured to ribs on the back surface of the antenna, it is preferably secured to the ribs by fasteners which are composed of polymeric material or other material of low thermal conductivity, which are spaced apart from each other, and which preferably prevent direct contact between the heater and the ribs. Preferably, however, the heater is secured to a back shell which is secured to the dish antenna around the perimeter thereof. The back shell is preferably environmentally sealed to the antenna, to minimize heat losses.

The first surface of the heater and/or the back surface of the dish antenna are preferably treated in some way which improves the emissivity thereof, for example by painting with a flat black paint. The second surface of the heater, on the other hand, is preferably such that its emissivity is low. Furthermore, the second surface is preferably substantially covered by thermal insulation material, eg. a foamed polymer, fiberglass or other void-containing polymeric material, either alone or backed by a metallic foil.

Any form of sheet heater can be used in this invention providing that it radiates heat sufficiently uniformly to warm the antenna without causing substantial distortion thereof. For this purpose, the radiant thermal output preferably does not vary by more than ±20%, particularly not more than ±10%, from the average value, when the thermal load is the same at all points on the heater, i.e. when the antenna is at a uniform temperature. Preferred heaters comprise a resistive element which is in the form of a sheet having electrodes secured (directly or indirectly) thereto. Preferably each of the electrodes is also in the form of a sheet, eg. a metal foil, the resistive element lying between the electrodes so that the current passes normally through the resistive element; however, other electrode arrangements are also possible. Satisfactory heaters can also be made by combining one or more strip heaters with a sheet of metal, eg. aluminum, or other material of high thermal conductivity. The strip heater(s) can be secured to one surface of the metal sheet, the opposite face then serving as the radiant surface, or can be sandwiched between two metal sheets, or can be embedded in the sheet. The arrangement and spacing of the strip heater(s) should be such as to provide a sufficiently uniform radiant heat output. Thus one or more strip heaters can for example be arranged in serpentine fashion; or a plurality of strip heaters can for example be arranged parallel to each other, together with electrical bus connectors to feed power to the heaters.

The heater is preferably self-regulating, ie. the higher the thermal load at any particular point on the heater (or in any particular zone which is small in comparison with the overall size of the heater), the higher the heat output of the heater at that point (or in that zone); this avoids overheating of the antenna in areas which are not being cooled by ice or snow, and results in remarkable temperature uniformity of the dish antenna, and consequent minimization of distortion of the antenna. The separation of the antenna and the self-regulating heater would be expected to result in a reduction of the sensitivity of the thermal output of the heater to the temperature of the antenna. In fact, however, the sensitivity is increased, and this apparently results from a combination of the self-regulating characteristic with the two factors discussed above (i.e. (1) a localized change in the temperature of the antenna is sensed not only by the portion of the heater directly opposite the change, but also by the adjacent parts of the heater, and (2) the heat transferred by radiation from the heater to the antenna is proportional to $T_H^4-T_A^4$).

Preferred self-regulating heaters for use in this invention comprise a PTC (positive temperature coefficient of resistance) conductive polymer composition which forms part or all of the resistive heating element or which acts as a control element for a ZTC (zero temperature coefficient) resistive heating element ie. a heating element whose thermal output is substantially independent of temperature, which may be composed of a conductive polymer composition or other material, e.g. a Nichrome or other resistive heating wire. Self-regulation through other PTC materials or through other means (e.g. the skin effect or the Curie point effect) is also possible.

If a self-regulating heater is not used, one or more thermostats may be used to control a ZTC heater.

For details of heaters, including self-regulating heaters, and conductive polymer compositions, reference may be made to U.S. Pat. Nos. 3,218,384, 3,296,364, 4,072,848, 4,117,312, 4,304,987, 4,330,703, 4,425,497, 4,429,216, 4,534,889 and 4,560,498, and copending commonly assigned U.S. application Ser. Nos. 720,118 (MP1039), 780,524 (MPO897) now abandoned, 810,134 (MP1034) now U.S. Pat. No. 4,849,611, 818,845 (MP1095) and 818,846 (MP1100), both now abandoned in favor of continuation-in-part application Ser. No. 75,929, and 864,930 (MP1090). The disclosure of each of those patents and patent applications is incorporated herein by reference.

Figure 2:
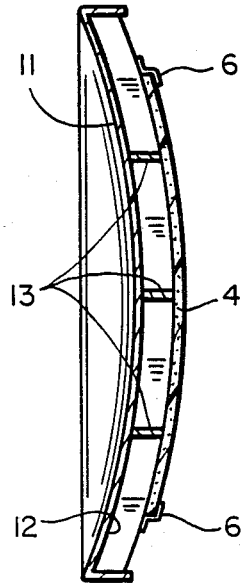
FIG. 2 is a diagrammatic cross-section on line AA of FIG. 1.

Referring now to the drawing, FIGS. 1 and 2 show a dish antenna 1 having a concave front surface 11 and a convex back surface 12 and a plurality of ribs 13 extending from the back surface. An electrical heater comprising four rectangular panels 2, 3, 4 and 5 is secured to the ribs by means of polymeric straps 6.

Figure 3:
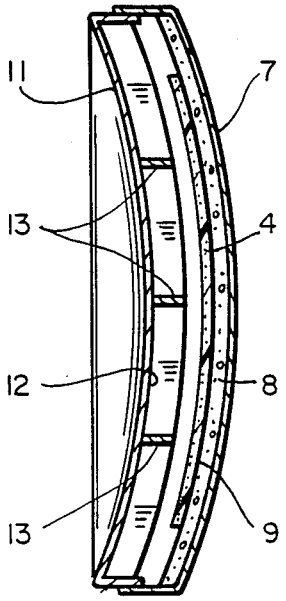
FIG. 3 is a diagrammatic cross-section of another assembly of the invention.

FIG. 3 is similar to FIG. 2, but shows an assembly further comprising a back shell 7, which is environmentally sealed to the periphery of dish antenna 1; the heater panels 2, 3, 4 and 5 are secured to the back shell 7 instead of to the ribs 13, and a layer 8 of fiberglass insulation secured to a metal foil 9 lies between the heater and the insulation.

Figure 4:
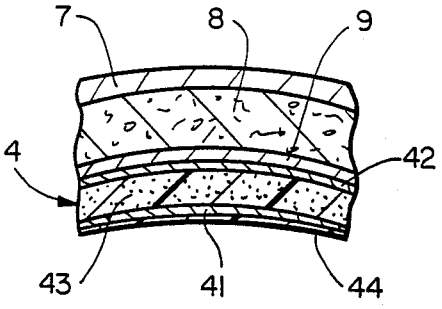
FIG. 4 is an enlarged and more detailed view of a part of FIG. 3.

As shown in the detailed view of FIG. 4, the heater comprises metal foil electrodes 41 and 42, with a PTC conductive polymer resistive heating element 43 sandwiched between them. The front surface of the heater has a coating 44 of flat black paint thereon.

Figure 5:
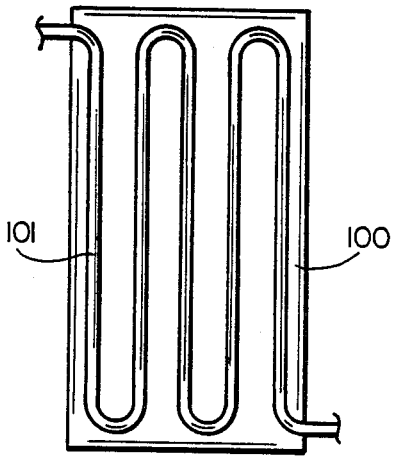
FIG. 5 is a diagrammatic plan view of another sheet heater which can be used in this invention.
Figure 6:
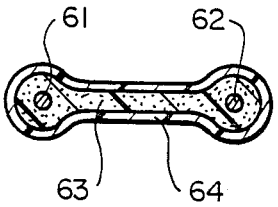
FIG. 6 is a diagrammatic cross-section through the strip heater used in FIG. 5.

FIG. 5 shows an alternative form of sheet heater for use in the invention which comprises a metal, eg. aluminum, plate 100 having a strip heater 101 secured one surface thereof. The first (radiant) surface of the heater is the opposite face. FIG. 6 is a cross-section through a preferred strip heater which comprises wire electrodes 61 and 62 embedded in a strip 63 of a PTC conductive polymer, and polymeric insulation 64 surrounding the strip 63.

The invention is further illustrated by the following Example.

EXAMPLE

A PTC conductive polymer powder was prepared by mixing 56% by weight of Marlex 50100 (high density polyethylene made by Phillips Petroleum), 43% by weight of Statex GH (carbon black made by Columbian Chemicals), and 1% by weight of an antioxidant in a Banbury mixer. The resulting compound was irradiated to a dose of 50 Mrads in a 3 MeV electron beam and pulverized until all the particles were smaller than 187 micrometers (80 mesh). This PTC powder was tumble-blended with an equal weight of FA750 (high density polyethylene made by USI Chemicals), and the blend was extruded into a 12 inch by 0.040 inch (30.5×0.10 cm) sheet.

Using a belt laminator set at 400° F. (204° C.), the sheet was laminated on each side with 0.001 inch (0.0025 cm) TEX-1 foil (nickel/zinc passivated electro deposited copper made by Yates).

A heater for a 1.8 meter diameter antenna was made as follows. The laminated sheet was trimmed into five approximately 10 by 60 inch (25.4 by 152.4 cm) panels. Electrical busbars were attached to the two surfaces of each panel by soldering 0.020 by 0.5 inch (0.05×1.27 cm) copper strips terminated with 16 AWG copper conductor onto the copper foil. Adjacent panels were electrically connected in parallel using a standard connection suitable for attachment to a 120 V power source. The panels and connections were electrically insulated by covering all surfaces completely with adhesive-backed Mylar tape. The first surface of the resulting heater (ie. the radiant surface) was then painted with flat black paint (Krylon) to enhance its thermal emissivity.

The heater was fastened with plastic straps to the back surface of the dish antenna, avoiding direct contact with all structural ribs. A back shell for the antenna was mated to the antenna, placing polyurethane foam between the back of the heater and the back shell to reduce heat losses.

We claim:

1. A dish antenna assembly which comprises
(1) a dish antenna having
(a) a concave front surface, and
(b) a convex back surface which comprises a plurality of ribs which extend therefrom; and
(2) an electrical heater which
(a) is in the form of a sheet having a first surface and an opposite second surface, the first surface being adjacent to the back surface of the antenna but separated therefrom by a medium which is substantially transparent to thermal radiation, whereby heat generated by the heater radiates from the first surface and strikes the back surface of the antenna, and
(b) is secured to the ribs by fastening members which are composed of polymeric material and which are spaced apart from each other.

2. An assembly according to claim 1 wherein the heater comprises
(a) a metal sheet having a first surface and an opposite second surface, the first surface being adjacent to the back surface of the antenna, and
(b) at least one resistive heating element which is in the form of a strip and which is secured to the second surface of the metal sheet.

3. An assembly according to claim 2 wherein the resistive heating element is a resistive heating wire.

4. A dish antenna assembly which comprises
(1) a dish antenna having a concave front surface and a convex back surface; and
(2) an electrical heater which
(a) is in the form of a sheet having a first surface and an opposite second surface, the first surface being adjacent to the back surface of the antenna but separated therefrom by a medium which is substantially transparent to thermal radiation, whereby heat generated by the heater radiates from the first surface and strikes the back surface of the antenna, and
(b) is a self-regulating heater which comprises a conductive polymer composition exhibiting PTC behavior.

5. An assembly according to claim 4 wherein the heater comprises two metal foil electrodes and a resistive heating element which is composed of a conductive polymer element exhibiting PTC behavior and which is in the form of a sheet lying between the foil electrodes.

6. An assembly according to claim 4 wherein the heater comprises
(a) a metal sheet having a first surface and an opposite second surface, the first surface being adjacent to the back surface of the antenna, and
(b) a self-regulating strip heater which comprises a conductive polymer composition exhibiting PTC behavior and which is secured to the second surface of the metal sheet.

7. An assembly according to claim 4 which comprises a back shell which is secured to the dish antenna around the perimeter thereof and to which the heater is secured, the heater being separated from the back surface of the antenna by air.

8. A dish antenna assembly which comprises
(1) a dish antenna having a concave front surface and a convex back surface; and
(2) an electrical heater which is in the form of a sheet having a first surface and an opposite second surface, the first surface being adjacent to the back surface of the antenna but separated therefrom by a medium which is substantially transparent to thermal radiation, whereby heat generated by the heater radiates from the first surface and strikes the back surface of the antenna, and wherein the ratio of the area of the first surface of the heater to the area of the back surface of the dish antenna is at least 0.3.

9. An assembly according to claim 8 wherein the ratio is 0.4 to 0.9.

10. An assembly according to claim 8 wherein the ratio is 0.5 to 0.8.

11. An assembly according to claim 8 wherein the heater comprises a resistive element which is in the form of a sheet and electrodes which are secured to the resistive element.

12. An assembly according to claim 8 wherein the heater comprises (a) a metal sheet having a first surface and an opposite second surface, the first surface being adjacent to the back surface of the antenna, and (b) at least one resistive heating element which is in the form of a strip and which is secured to the second surface of the metal sheet.

13. An assembly according to claim 8 which comprises a back shell which is secured to the dish antenna around the perimeter thereof and to which the heater is secured, the heater being separated from the back surface of the antenna by air.

14. A dish antenna assembly which comprises (1) a dish antenna having a concave front surface and a convex back surface; and (2) a plurality of electrical heaters which are connected in parallel, each of which is in the form of a sheet having a first surface and an opposite second surface, the first surface being adjacent to the back surface of the antenna but separated therefrom by a medium which is substantially transparent to thermal radiation, and at least one of which comprises a resistive heating element which is in the form of a substantially rectangular sheet, whereby heat generated by the heater radiates from the first surface and strikes the back surface of the antenna.

15. An assembly according to claim 14 which comprises a back shell which is secured to the dish antenna around the perimeter thereof and to which the heater is secured, the heater being separated from the back surface of the antenna by air.

16. A dish antenna assembly which comprises (1) a dish antenna having a concave front surface and a convex back surface;

(2) a self-regulating electrical heater which (a) is in the form of a sheet having a first surface and an opposite second surface, the first surface being adjacent to the back surface of the antenna but separated therefrom by air, and (b) comprises two metal foil electrodes and a resistive heating element which is composed of a conductive polymer element exhibiting PTC behavior and which is in the form of a sheet lying between the foil electrodes, whereby heat generated by the heater radiates from the first surface and strikes the back surface of the antenna;

(3) thermal insulation which substantially covers the second surface of the heater; and (4) a back shell which is environmentally sealed to the dish antenna, with the heater and the thermal insulation between the antenna and the back shell.

17. A dish antenna assembly which comprises (1) a dish antenna having a concave front surface and a convex back surface;

(2) a self-regulating electrical heater which is in the form of a sheet having a first surface and an opposite second surface, the first surface being adjacent to the back surface of the antenna but separated therefrom by air, whereby heat generated by the heater radiates from the first surface and strikes the back surface of the antenna;

(3) thermal insulation which substantially covers the second surface of the heater; and (4) a back shell which is environmentally sealed to the dish antenna, with the heater and the thermal insulation between the antenna and the back shell, wherein the ratio of the area of the first surface of the heater to the area of the back surface of the dish antenna is 0.5 to 0.8.

18. An assembly according to claim 17 wherein the heater comprises (a) a metal sheet having a first surface and an opposite second surface, the first surface being adjacent to the back surface of the antenna, and (b) at least one resistive heating element which is in the form of a strip and which is secured to the second surface of the metal sheet.

19. An assembly according to claim 18 wherein the resistive heating element is composed of a conductive polymer exhibiting PTC behavior.

20. A dish antenna assembly which comprises (1) a dish antenna having a concave front surface and a convex back surface;

(2) a plurality of self-regulating electrical heaters which are connected in parallel, each of which is in the form of a sheet having a first surface and an opposite second surface, the first surface being adjacent to the back surface of the antenna but separated therefrom by air, and at least one of which is in the form of a substantially rectangular sheet, whereby heat generated by the heater radiates from the first surface and strikes the back surface of the antenna;

(3) thermal insulation which substantially covers the second surface of the heater; and (4) a back shell which is environmentally sealed to the dish antenna, with the heater and the thermal insulation between the antenna and the back shell.

21. An assembly according to claim 20 wherein the heater comprises (a) a metal sheet having a first surface and an opposite second surface, the first surface being adjacent to the back surface of the antenna, and (b) at least one resistive heating element which is in the form of a strip and which is secured to the second surface of the metal sheet.

22. An assembly according to claim 21 wherein the resistive heating element is composed of a conductive polymer exhibiting PTC behavior.

* * * * *

Disclaimer 4,866,452—*Pradeep Barma*, Fremont; *Chi-Ming Chan*, Palo Alto, both of Calif. HEATED DISH-ANTENNAS. Patent dated Sept. 12, 1989. Disclaimer filed May 20, 1991, by the assignee, Raychem Corp.

The term of this patent subsequent to Sept. 12, 2006, has been disclaimed.

[ *Official Gazette August 27, 1991* ]